US008163453B2

(12) United States Patent
Anno et al.

(10) Patent No.: US 8,163,453 B2
(45) **Date of Patent: *Apr. 24, 2012**

(54) TONER HAVING PARTICLES AND TITANATE COMPOUND

(75) Inventors: Masahiro Anno, Hachioji (JP); Yukio Hosoya, Tama (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 770 days.

This patent is subject to a terminal disclaimer.

(21) Appl. No.: 12/272,651

(22) Filed: Nov. 17, 2008

(65) Prior Publication Data

US 2009/0142684 A1 Jun. 4, 2009

(30) Foreign Application Priority Data

Nov. 30, 2007 (JP) ..... 2007-310026

(51) Int. Cl.
*G03G 9/087* (2006.01)

(52) U.S. Cl. ..... 430/108.6; 430/111.4

(58) Field of Classification Search ..... 430/108.6, 430/111.4, 45.4
See application file for complete search history.

(56) References Cited

U.S. PATENT DOCUMENTS

| | | | | |
|---|---|---|---|---|
| 6,780,555 | B2 * | 8/2004 | Uchida et al. | 430/106.2 |
| 6,953,504 | B2 * | 10/2005 | Nakata et al. | 106/439 |
| 7,459,252 | B2 * | 12/2008 | Yaguchi et al. | 430/108.6 |
| 2004/0234879 | A1 * | 11/2004 | Hasegawa et al. | 430/108.3 |

FOREIGN PATENT DOCUMENTS

| | | | |
|---|---|---|---|
| JP | 60032060 | A * | 2/1985 |
| JP | 2009063616 | A * | 3/2009 |

* cited by examiner

*Primary Examiner* — Christopher Rodee
(74) *Attorney, Agent, or Firm* — Squire Sanders (US) LLP

(57) ABSTRACT

Disclosed is a toner which can be charged at a designated level even when a lot of print is carried out with severity of charging by stirring and when the printing is carried out under the low temperature-low humidity or the high temperature-high humidity condition. A toner comprising (a) a particle comprising a resin and a colorant; and (b) a titanate compound on the surface of the particle, in which the titanate compound contains iron in an amount of from 100 ppm to 1,000 ppm.

11 Claims, 4 Drawing Sheets

TONER HAVING PARTICLES AND TITANATE COMPOUND

TECHNICAL FIELD

The present invention relates to a toner to be used for an electrophotographic image forming apparatus, particularly to a toner containing a titanate compound as an external additive.

BACKGROUND

A toner to be used in an electrophotographic image forming apparatus usually contains inorganic or organic particles called as an external additive on the surface of the toner particles for attaining suitable image formation. The toner is designed so as to hold the properties of toner such as the charging property and fluidity by the influence of the external additive.

The compounds to be used as the external additive include a titanate compound typified by calcium titanate and strontium titanate. It has been known that the use of the titanium compound as the external additive in the toner is effective for preventing occurrence of filming on the photoreceptor surface and improving the cleaning suitability of the toner.

Moreover, it is considered that the titanate compound contributes to improving the charging property since the titanate compound has high dielectricity. Consequently, it is tried hitherto to improve the charging property of the toner. For example, a technique is known in which a negatively chargeable magnetic toner containing metal titanate particles is used to reduce the consumption of the toner by lowering the coagulation between the toner particles by the high dielectricity of the metal titanate particle; cf. Patent Publication 1. Besides, another technique is known in which stability of charging property is realized by increasing the charging property of small diameter toner particles by specifying the variation coefficient of the shape coefficient and number variation coefficient of number distribution particle size and adding the titanate compound as the external additive; Patent Publication 2.

Patent Publication 1: Tokkai Hei 8-334918
Patent Publication 2: Tokkai 2001-290302

SUMMARY

Problems to be Solved by the Invention

It is unexpectedly difficult to stably perform the charging of toner under various conditions for producing various prints such as practical print making on the market. In the case of intermittently printing several sheets of prints, for example, the prints are made under a suitable charging condition since the toner is sufficiently stirred in the image forming apparatus. On the other hand, there is a case on the practical market that several thousands prints are continuously printed such as on-demand printing. For such the continuous printing, the toner is necessarily designed so as that the toner is stably charged between a short duration of stirring.

When the printing is carried out under a low temperature-low humidity condition, the saturation charging amount of the toner is increased accompanied with lowering in the moisture content of air. Therefore, influences on the raising up property of charging, toner flying to the photoreceptor and toner conveying in the apparatus are anxious. When the printing is carried out under a high temperature-high moisture condition, it is anxious that the holding of charge is inhibited because the charge is easily leaked by the influence of the moisture in air.

By the above reasons, it is considered that the charging of toner at a designated level under the state receiving the effects of various environmental factors accompanies difficulty. Therefore, it is not cleared that the toner containing the titanate compound can realize how degree the stably charging under such the conditions. An object of the invention is to provide a toner capable of stably being charged without the influence of the printing conditions and the installation environment of the apparatus.

Namely, an object of the invention is to provide a toner which can be charged at a designated level even when a lot of print is carried out with severity of charging by stirring and when the printing is carried out under the low temperature-low humidity or the high temperature-high humidity condition. Concretely, the object is to provide a toner which is inhibited in the occurrence of fog on the photoreceptor or image and the variation of the image density under the high temperature-high humidity or the low temperature-low humidity condition.

It is found by the inventors that the above problems can be solved by the following constitution.

1. A toner comprising a particle comprising a resin and a colorant and a titanate compound added onto the surface of the particle, in which the titanate compound contains iron in an amount of from 100 ppm to 1,000 ppm.
2. The toner described in 1, in which titanate compound is calcium titanate or strontium titanate.
3. The toner described in 1 or 2, in which the BET specific surface area of the titanate compound is from 5 $m^2/g$ to 25 $m^2/g$.
4. The toner described in any one of 1 to 3, in which the titanate compound has a number average particle diameter of from 50 nm to 2,000 nm and a standard deviation of the particle diameter of not more than 250 nm.
5. The toner described in any one of 1 to 4, in which the adding amount of the titanate compound is from 0.1% by weight to 10.0% by weight.
6. The toner described in any one of 1 to 5, in which the acid value of the toner is from 7 KOH mg/g to 25 KOH mg/g.
7. The toner described in 1, in which the titanate compound contains iron in an amount of from 100 ppm to 500 ppm.
8. The toner described in 1, in which the titanate compound has a number average particle diameter of from 50 nm to 400 nm and a standard deviation of particle diameter of not more than 250 nm.
9. The toner described in 1, in which the adding amount of the titanate compound is form 0.3% by weight to 5.0% by weight.
10. The toner described in 1, in which the adding amount of the titanate compound is form 0.4% by weight to 2.0% by weight.
11. The toner described in 1, in which the acid value of the toner is from 7 KOH mg/g to 25 KOH mg/g.
12. A image forming method in which the toner described in 1 through 11 is used for forming a full color image in a state of non-magnetic single-component developer.

Effects of the Invention

The charging property of the toner can be stably held without the influence of printing environment by adding the titanate compound containing iron in an amount of from 100 ppm to 1,000 ppm to the toner according to the invention.

When a lot of print is continuously printed, sufficient charging can be carried out within the limited period. Moreover, printing can be smoothly carried out without influence on the raising up property of charging when the printing is performed under the low temperature-low humidity condition in which the saturating charging amount tends to rise. The charging property of the toner can be held by inhabitation of moisture adsorption onto the toner surface by the addition of titanate compound to the toner particle surface when the printing is carried out in the high temperature-high humidity environment in which the charge is easily leaked by the effect of the moisture in air.

Stable charging property can be obtained and high quality and high definition images suitable for digital image formation can be obtained when the toner of the invention prepared by using colored particles formed in an aqueous medium is used for image formation. Furthermore, the titanate compound is not released from the toner surface and contamination of developing roller or photoreceptor surface is not observed even when the printing is carried out under a condition in which the same toner is repeatedly stirred for long period such as that in small amount printing.

As above-mentioned, the above effects can be obtained by finding the toner of the invention containing the titanate compound containing the specific amount of iron. The reason of stabilization of the charging property of toner by the use of the titanate compound containing the specified amount of iron is supposed that the presence of the iron affects to improve the charging property of the toner additionally to the high dielectricity of the titanate compound.

Namely, it is supposed that the accumulation of charge is accelerated by the high dielectricity of the titanate compound and excessive charge is released from the toner through the iron atoms when the charge is excessively raised so that the charging amount of the toner is held at a certain level. As a result of that, it is supposed that toner images having the designated density are always stably formed without any influence of the printing conditions and the environment of the apparatus.

As above-mentioned, the invention can be attained based on the find out notating the iron content in the titanate compound that the charging property of the toner can be held at a constant level by specifying the content of the iron. Such the knowledge is firstly obtained in the invention. In the techniques disclosed in the foregoing Patent Publications 1 and 2, effects of each of the disclosures are found by notating the high dielectricity of the titanate compound. However, these publications do not disclose anything suggesting that the presence of iron in the titanate compound is effective for obtaining any effect. In the present invention, the toner displaying the effects of the invention can be realized by utilizing the high dielectricity of the titanate compound and the charging controlling function of iron contained in the titanate compound in suitable balance.

Figure 1:
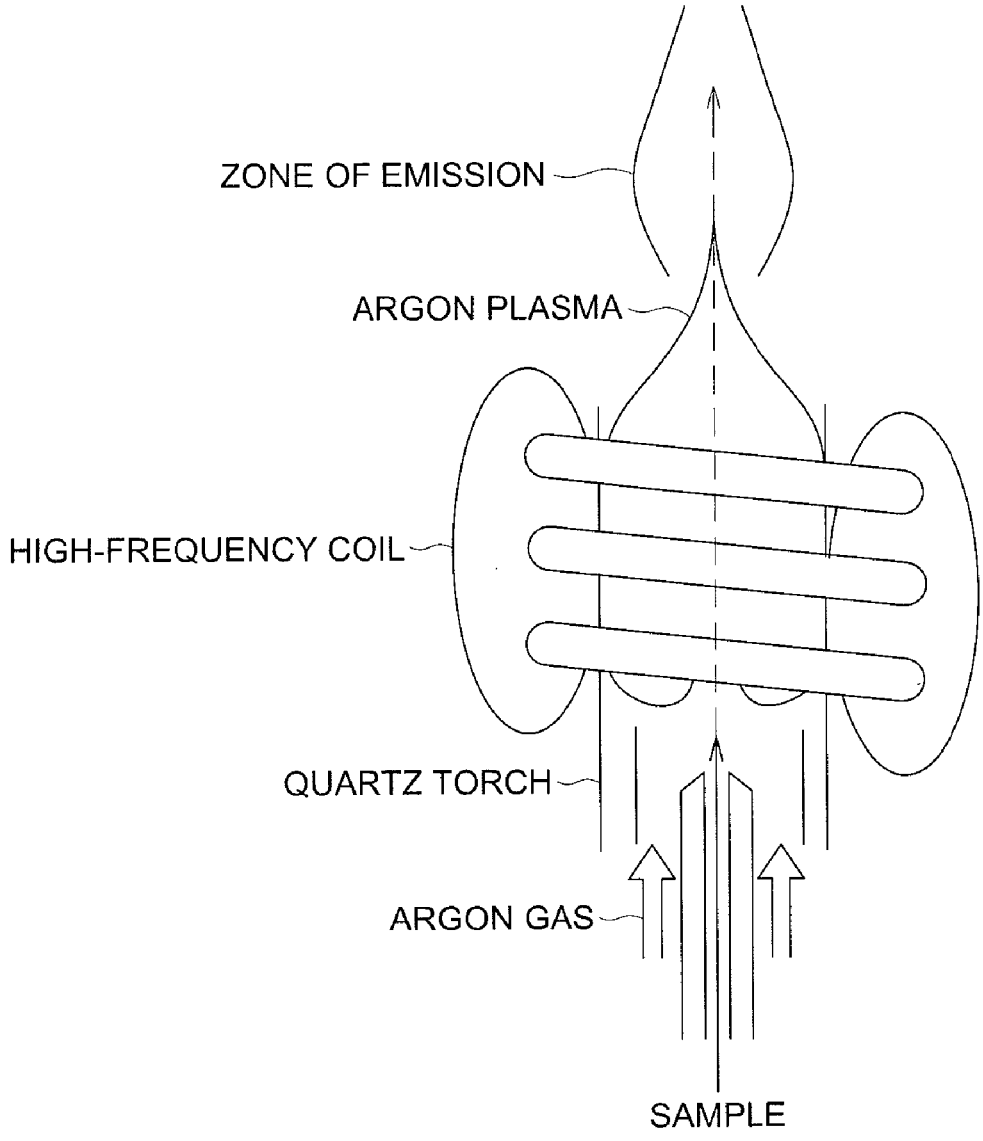
FIG. 1 is a schematic drawing of the inductively coupled plasma atomic emission spectroscopic analysis method.

| [Description of sign] | |
|---|---|
| 1 | Photoreceptor |
| 2 | Charging means |
| 3 | Exposing means |
| 4 | Developing means, developing device, toner cartridge |
| 41 | Developing roller |
| 5 | Primary transfer roller |
| 6 | Cleaning means |
| 7 | Endless belt-shaped intermediate transfer member unit |
| 8 | Fixing device |
| 10 | Image forming portion |

DESCRIPTION OF THE PREFERRED EMBODIMENTS

The invention is described in detail below.

The titanate compound to be used in the invention contains iron in an amount of from 100 ppm to 1,000 ppm, and preferably from 100 ppm to 500 ppm. In the invention, it is supposed that the high dielectricity of the titanate compound and the charging effect of the ion atoms are displayed in suitable balance so as to stabilize the charging property of the toner by making the content of iron in the titanate compound to be used as the external additive to a value within the range of from 100 ppm to 1,000 ppm.

When the iron content in the titanate compound is less than 100 ppm, the charging ability is lowered and the leaking is difficultly caused. As a result of that, the charge is easily accumulated on the toner so that the saturation charging amount is excessively increased. Particularly, under the low temperature-low humidity condition in which charge leaking by the moisture in the atmosphere becomes difficult, the saturation charging amount is further increased so that flying the toner to the photoreceptor is caused and control of the conveying amount of the toner in the developing apparatus is difficultly performed.

Besides, when the iron content in the titanate compound exceeds 1,000 ppm, it is supposed that the charge cannot be accumulated on the toner surface since the leaking of charge is frequently caused.

As above-described, the toner of the invention is a toner comprising the particle comprising a resin and a colorant and titanate compound added as the external additive which contains iron in an amount of from 100 ppm to 1,000 ppm. The titanate compound is a salt formed from titanium (IV) oxide and another metal oxide or metal carbonate which is also called as metatitanate and represented by the following Formula I.

$$M^{I}_{2}TiO_3 \text{ or } M^{II}TiO_3 \qquad \text{Formula I}$$

In the above, $M^{I}$ is a mono-valent metal atom and $M^{II}$ is a di-valent metal atom.

In the invention, "iron content" means the weight of iron contained in a unit weight of the titanate compound. In the invention, the iron (atom) is contained in the titanate compound in an amount of from 100 ppm to 1,000 ppm. It is supposed that the ion atoms are contained in the titanate compound in a state of a iron compound such as iron (III) oxide or a state of built-in the crystal lattice.

In the invention, a titanate compound bonded with a divalent metal represented by $M^{II}TiO_3$ is preferably used. Concrete examples of the titanate compound bonded with the divalent metal include calcium titanate $CaTiO_3$, magnesium titanate $MgTiO_3$, strontium titanate $SrTiO_3$ and barium titanate $BaTiO_3$. Among them, calcium titanate $CaTiO_3$ and magnesium titanate $MgTiO_3$ are preferable from the viewpoint of influence on the environment and calcium titanate $CaTiO_3$ is more preferable since the charging amount can be held at a constant level for long period by it.

The titanate compound to be used in the invention contains iron in an amount of from 100 ppm to 1,000 ppm, and the content of the iron atoms in the titanate compound can be controlled by controlling the amount of iron compound such as iron chloride, iron sulfide and iron oxide which is added occasion of preparation of the titanate compound. It is considered that the titanate compound can stably hold the added iron atoms.

The content of iron in the titanate compound can be measured by inductively coupled plasma atomic emission spectroscopy (ICP-AES). In the inductively coupled plasma (ICP) emission spectroscopic method, the sample is introduced into high temperature of about 6,000° K or more of argon plasma and emitted light is measured for carrying out high sensitive qualitative or quantitative analysis. The wavelength of light emitted from the iron contained in the titanate compound is characteristic of iron atom and the intensity of the emitted light is proportional to the content of iron atom in the sample, therefore the amount of iron contained in the titanate compound can be determined.

The measurement of iron content in the titanate compound by the inductively coupled plasma atomic emission spectroscopic analyzing apparatus is carried out according to the following procedure.

(1) One gram of titanate compound to be measured is put into a dried 200 ml conical beaker.

(2) Twenty milliliter of sulfuric acid is added as a decomposing agent and the resultant mixture is subjected to a micro wave decomposing treatment by a closed type micro wave wet decomposing apparatus MLS-1200MEGA, manufactured by Milestone Microwave Laboratory System, until insoluble matter is disappeared.

(3) The microwave treatment is stopped after confirmation of absent of any insoluble matter and the solution was cooled by water.

(4) The resultant solution of decomposed matter is transferred to a 100 ml messflask and made up to 100 ml by filling until the marking line by distillated water to prepare a sample solution.

(5) Then 25 ml of the sample solution was transferred to a 100 ml messflask and made up to 100 ml by adding distillated water until the mark line to prepare an analysis sample.

(6) The iron content is measured by introducing the analysis sample into the above described inductively coupled plasma atomic emission spectroscopic apparatus. The quantitative analysis of the iron content is carried out by measuring the intensity of light of 238.204 nm (corresponding to the wavelength of light emitted by iron atom) and referring a calibration curve of iron content.

The calibration curve is prepared by the following procedure.

(1) Each of the titanate compounds such as calcium titanate, strontium titanate and magnesium titanate is subjected to the decomposing treatment the same as that in the above-mentioned.

(2) The solution of the decomposed matter is transferred to a 100 ml messflask and adjusted to 100 ml by filling until the marking line by adding distillated water to prepare a sample solution.

(3) Twenty five milliliters of the sample solution is put into each of 100 ml mess flasks, and a standard solution of iron was added to each of the above flasks so that the content of iron is 0 ppm, 250 ppm, 500 ppm, 750 ppm and 1,000 ppm, respectively and filled up to 100 ml to prepare samples for preparing the calibration curve.

(4) Calibration curves are prepared according to the above four points as to each of the titanate compounds.

The schematic drawing of the inductively coupled plasma atomic emission spectroscopic analysis method is displayed in FIG. 1.

The titanate compound having a BET specific surface area of from 5 $m^2/g$ to 20 $m^2/g$ is preferable for use in the invention. It is supposed that a field in which exchanging of charge between the titanate compound and the surface of toner particle is easily carried out is formed when the value of the BET specific surface area is within the above range. Namely, it is supposed that the titanate compound added onto the toner surface acts as a suspected carrier or a condenser so that the charging property of the toner is effectively controlled when the BET specific surface area is within the above range. For example, under the low temperature-low humidity condition in which the toner tends to be excessively charged, a suitable contacting area between the titanate compound and the toner is kept so that the charge is released from the excessively charged tone through the iron atoms. Besides, under a high temperature and high humidity condition in which leaking of the charge is easily caused, the titanate compound acts as a suspected toner and supplies charge necessary for forming images at the designated level so as to hold the charging property of the toner.

The BET specific surface area is a specific surface area calculated by a gas adsorption. In the gas adsorption method, the specific surface area is calculated from the amount of adsorbed gas when a gas having an known occupying area of adsorbed gas such as nitrogen gas is adsorbed onto a particle. The amount of the gas molecule directly adsorbed on the surface of a solid matter can be exactly calculated by the measurement by the BET specific surface area method. The BET specific surface area can be calculated according to the following equation called as BET equation.

The BET equation displays the relation between the equilibrium adsorption pressure at an equilibrium adsorbing state at a constant temperature and the adsorbed amount under such the pressure is expressed by the following equation.

$$P/V(P_0-p)=(1/VmC)+((C-1)/VmC)(P/P_0) \quad \text{Equation 1}$$

In the above;

$P_0$: Saturated vapor pressure

Vm: Adsorption amount of mono molecular absorption layer, the adsorption amount of gas molecules when the gas forms a monomolecular adsorption layer on the solid surface.

C: A parameter relating to the adsorption heat

The mono molecular layer adsorption amount Vm is calculated by the above equation and the surface area of the particle can be calculated by the product of Vm and the cross section area occupied by one gas molecule.

The BET specific surface area in the invention is a value calculated by the following measuring method using an automatic specific surface area measuring apparatus GEMINI 2360, manufactured by Shimadzu Micromeritics Corp.

Firstly, 2 g of titanate compound is charged in a straight sample cell and the air in the cell is replaced by nitrogen gas (purity: 99.999%) as a pretreatment. Then the nitrogen gas (purity: 99.999%) is adsorbed and desorbed on the pretreated composite compound and the specific surface area is calculated by multi-point (7 points) method.

The titanate compound to be used in the invention preferably has a number average particle diameter of from 50 nm to 2,000 nm, and more preferably from 50 nm to 400 nm. It is supposed that improvement of the charging property of the toner is improved and more stabilized by reducing the scattering of the charging property of the toner particles by controlling the sized of the titanate compound into the above range. Reason of the above effects may be that strongly fixing of the titanate compound onto the toner surface is avoided by making the number average particle diameter of the titanate compound to not less than 50 nm. It is considered that the titanate compound containing the specified amount of iron atom contributes in well balance to hold the charging property of the toner and to improvement of the fluidity since the titanate compound exists in the state of not strongly fixed on the toner surface.

It is supposed that the titanate compound to be used in the invention having the number average particle diameter on not more than 2,000 nm is contributes to improvement of the charging property since the titanate compound having such the particle diameter is not easily released from the toner surface. The toner before using is strongly receives stress by frequently stirring in the developing apparatus sometimes, for example, in a case of printing small number of sheet. The titanate compound is difficultly released from the toner surface even when the toner is received strong stress. Therefore, it is considered that the charging property of the toner is suitably held in such the printing condition.

The number average particle diameter of the titanate compound can be calculated from electronmicroscopic image. Concretely, it can be calculated by the following procedure.

(1) The toner is photographed in a magnification of 30,000 by a scanning type electronmicroscope and the photographic image is read by a scanner.

(2) The photograph of the titanate compound particle adhering on the toner surface is subjected to binarization treatment by an image analyzing apparatus LUZEX AP, manufactured by NERCO Corp., and horizontal fere diameters of 100 particles are calculated and the average value of the fere diameters is defined as the average particle diameter. The horizontal fere diameter is a distance between a pair of parallel perpendicular lines each touching each other of the outlines of the particle image.

Moreover, the average particle diameter also can be calculated by the same procedure as the above using the photo picture taken by directly photographing the titanate compound by the scanning electronmicroscope other than the method by photographing the toner particles and calculating the diameter of the titanate particles adhering on the toner particle.

The titanate compound to be used in the invention is preferably one having a value of standard deviation of the particle diameter of not more than 250 nm. It is considered that the titanate compound particles have the contribution ability to the charging without scattering and any particles display charging property at similar level so as to contribute to realizing uniform charging of the toner.

The standard deviation of particle diameter (SD value) represents the number-based particle distribution of the titanate compound particles, and the value can be obtained as follows; the number-based 84%-particle size and the number-based 16%-particle size are measured by the above-mentioned method for measuring the number average particle sizes and the difference of the above values is divided in 2. Namely, the standard deviation (SD value) of particle diameter is expressed as follows:

Standard deviation of particle diameter (SD value)= {Number-based 84%-diameter ($D84$)−Number-based 16% diameter ($D16$)}/2

The adding amount of the titanate compound is preferably from 0.1 to 10.0% by weight to the entire toner. In such the range, a ratio of from 0.3% to 5.0% by weight is more preferable and that from 0.4% to 2.0% by weight is particularly preferable. The stabilization of the charging property of the toner is certainly obtained when the adding amount of the titanate compound is within the above range. At the same time, the surface of the photoreceptor is not damaged by the titanate compound released from the toner since the titanate compound particles added to the toner are not released from the toner surface. Titanate compound particles treated on the surface by silicone oil can be used. By using such the titanate compound, the charging property of the toner such as stability as to the environmental condition can be improved while inhibiting the contamination by the toner on the carrier or the developing roller.

The titanate compound to be used in the invention can be produced by a known method. As the method for producing the titanate compound to be used in the invention, a method is cited, in which the titanate compound is produced through titanium (IV) oxide in a hydrated form $TiO_2.H_2O$ called as metatitanic acid. In such the method, the titanium (IV) oxide is made react with a metal carbonate such as calcium carbonate or a metal oxide and then the titanate compound such as calcium titanate is formed by roasting.

The hydrolyzed product of titanium oxide such as metatitanic acid is also called as deflocculated mineral acid which is a liquid containing dispersed particles of titanium oxide. A water soluble metal carbonate or a metal oxide is added to the deflocculated mineral acid and the mixture is made react while adding an aqueous solution of an alkali at 50° C. to prepare the titanate compound.

One of typical example of the deflocculated mineral acid has a sulfite content of not more than 1.0%, preferably not more than 0.5%, by weight and is prepared by deflocculating by controlling the pH to a value within the range of from 0.8 to 1.5 by hydrochloric acid.

As the alkali solution, an aqueous solution of caustic alkali such as sodium hydroxide is preferably used. As the compound to react with the hydrolyzed product of titanium oxide, nitrate, carbonate and chloride of strontium, magnesium, calcium, barium, aluminum, zirconium and sodium are usable.

In the production process of the titanate compound, the additional ratio of the hydrated compound or hydrolyzed product of titanium oxide to the metal oxide, the concentration of the hydrated compound or hydrolyzed product of titanium oxide during the reaction and the temperature at the addition and the rate of addition of the alkali aqueous solution can be controlled for controlling the particle size of the titanate compound. The reaction is preferably carried out under nitrogen gas atmosphere for preventing formation of carbonate compound in the course of the reaction.

The additional ratio (in mole ratio) of the metal oxide to the hydrolyzed product of titanium oxide, Metal oxide/$TiO_2$< is from 0.9 to 1.4 and preferably from 0.95 to 1.15. The concentration of the titanium oxide hydrolyzed product at the early period of the reaction is from 0.05 to 1.0 mole/L and preferably from 0.1 to 0.8 moles/L in terms of $TiO_2$.

The temperature on the occasion of adding the alkali aqueous solution of from 50° C. to 101° C. is practically preferable though crystalline particle can be obtained at higher temperature. The adding rate of the alkali aqueous solution tends to influence to the particle diameter of the titanate compound, and larger particles of the titanate compound tend to be formed by slower adding rate and smaller particles tend to be formed by faster adding rate. The adding rate of the alkali aqueous solution is from 0.001 to 1.0 equiv/h, and preferably from 0.005 to 0.5 equiv/h, to the charged raw material and can be suitably varied according to desired particle diameter. The adding rate of the alkali aqueous solution also can be varied in the course of the addition depending on the purpose.

As the method for adding the iron atoms into the titanate compound, a known method can be applied without any limitation. For instance, calcium titanate can be obtained by a method in which a compound containing iron atom is added on the occasion of mixing the hydrolyzed product of titanium oxide (metatitanic acid) and calcium oxide. As the compound containing iron atom, a water-soluble iron oxide compound such as ferrous chloride $FeCl_2$, ferric chloride $FeCl_3$, ferrous sulfate $FeSO_4$ and ferric sulfate $Fe_2(SO_4)_3$ are preferably cited additionally to powder or slurry of iron oxide. Such the iron oxide compounds are preferably used in a form of anhydrous or hydrated compound. Besides, a concrete example of the method for preparing the titanate compound containing iron atoms by adding an aqueous solution of ferric chloride on the occasion of mixing metatitanic acid and calcium carbonate is described in Examples.

The toner relating to the invention is described below. The toner relating to the invention is a toner containing the titanate compound containing 100 ppm to 1,000 ppm of iron as the external additive and the production method of the colored particle constituting the toner (particles before addition of the external additive, which is also referred to as mother particle of toner) is not specifically limited. The size of the toner is firstly described.

The sized of the toner is preferably from 3 μm to 8 μm in volume-based median diameter (D50). Such the toner classified into a small diameter toner is suitable for reproducing high definition dot images corresponding to digital technology.

The volume-based median diameter (D50) can be measured and calculated by using, for example, Multisizer 3, manufactured by Beckman Coulter Inc., connected with a computer system applying a data processing software "Software V3.51".

The measurement is carried out according to the following procedure, for example; 0.02 g of the toner is wetted by 20 ml of surfactant solution (for example, a solution prepared by diluting 10 times a neutral detergent containing a surfactant with purified water for dispersing the toner) and dispersed for 1 minute by ultrasonic wave to prepare a toner dispersion. The toner dispersion is injected by a pipette into a beaker containing ISOTON II, manufactured by Beckman Coulter Inc., placed on the sample stand until the concentration is made to a measuring concentration of from 5 to 10%. And then the counter of the apparatus is set at 25000 particles and measurement is carried out. The aperture of Multisizer 3 having a diameter of 50 μm is used.

The producing method of the toner of the invention is described below.

The colored particle constituting the toner of the invention comprises a resin and a colorant. The producing method of the colored particles constituting the toner of the invention is not specifically limited. In the invention, the colored particle is a particle before addition of the external additive and corresponds to a mother body constituting the toner. As above-mentioned, high definition dot images not at all inferior to photographic images and printed images accompanied with recent progress of digital technology. Particularly, a printing business complying with order of small amount of prints called as on-demand printing is noted because necessary amount of prints can be rapidly prepared without producing any printing plate by the electrophotographic image forming apparatus. Needs for toner capable of forming high definition and high quality images rises on such the background, particularly a toner having uniform charging amount distribution is required.

It is considered by the inventors that the toner having sharp charging amount distribution can be obtained by producing the toner having no fluctuation in the particle diameter and shape in the producing processes and the toner is preferably produced by a polymerization method in which the toner can be formed by applying operations for controlling the diameter or the shape in the course of the production processes. It is considered that an emulsion association method is one of most useful methods among the polymerization methods in which resin fine particles of about 120 nm are previously prepared by an emulsion polymerization method or a suspension polymerization method and the fine resin particles are coagulated for forming the colored particles having the foregoing particle diameter.

However, the toner produced by the polymerization method tends to orient polar groups on the surface thereof since the toner particles are formed in an aqueous medium. Therefore, it is anxious that the charge generation property and the charge holding property of the toner are influenced by the affect of the polar groups oriented on the toner surface. Particularly, stability of printing under a high temperature and high humidity condition is anxious. However, the anxiety is solved since the toner produced by externally adding the titanate compound containing 100 ppm to 1,000 ppm of iron to the colored particles prepared by the polymerization method displays stable charge generating property and the charge holding property even under the high temperature and high humidity condition. Such the effect is presumed that the surface of the toner particle is occupied in some degree by the externally added titanate compound containing iron in an amount within the above range so that adsorption of water molecules in air to the polar groups oriented on the toner surface is inhibited and charging property of the toner can be held.

It is also presumed that the adhesiveness of the titanate compound to the toner surface is strengthen by the polar groups oriented on the toner surface. It is expected by the strengthening of the adhesiveness that the titanate compound is difficultly released from the toner surface even when the toner is repeatedly stirred in the image forming process. As above-described, it is confirmed that stable charging property can be obtained and high definition and high quality prints can be stably produced by the toner prepared by externally adding the titanate compound containing iron in an amount of 100 ppm to 1,000 ppm to colored particles formed by the emulsion association method.

Toner production by the emulsion association method as an example of the toner production method relating to the invention is described below. The toner production by the emulsion association method is carried out by the following processes.

(1) Process for producing fine resin particles (2) Process for producing a fine colorant particle dispersion.

(3) Process for coagulating and fusing fine resin particles (4) Ripening process (5) Cooling process (6) Washing process (7) Drying process (8) External additive treatment process The processes are respectively described below.

(1) Process for Producing Fine Resin Particles

In this process, fine resin particles having a size of about 100 nm are formed by adding a polymerizable monomer for forming the fine resin particles into an aqueous medium and polymerizing the monomer. Fine resin particles containing wax also can be produced. In such the case, the fine resin particles containing the wax can be formed by dissolving or dispersed the wax in the polymerizable monomer and polymerizing it.

(2) Process for Producing a Fine Colorant Particle Dispersion.

In this process, a colorant is dispersed in an aqueous medium to prepare a colorant fine particle dispersion having a size of about 110 nm.

(3) Process for Coagulating and Fusing Fine Resin Particles

In this process, the rein fine particles and the colorant particles are coagulated in an aqueous medium and the coagulated particles are fused to prepare colored particles. The process corresponds to a process so-called "process for coagulating resin particles".

In this process, a coagulant such as an alkali metal salt and an alkali-earth metal salt typified by magnesium chloride is added to the aqueous medium in which the fine resin particles and the colorant particles are dispersed and the system is heated by a temperature not less than the glass transition point of the fine resin particles and the melting peak temperature of the mixture for simultaneously progressing coagulation and fusion between the resin particles.

Then the coagulation is stopped by adding a salt such as sodium chloride when the size of the particle is reached at the desired value.

(4) Ripening Process

In this process, the shape of the colored particles is made to desired average circularity by heating the reaction system continuously to the above coagulation and fusion process.

(5) Cooling Process

This process is a process for cooling (rapidly cooling treatment) the dispersion of the colored particles. The cooling is carried out at a cooling rate of from 1 to 20° C./min. A cooling method by externally introducing a cooling medium to outside of the reaction vessel and a method by directly pouring cool water into the reactive system can be exemplified though the method for cooling is not specifically limited.

(6) Washing Process

This process is composed of a process for separating the colored particles from the colored particle dispersion and a process for washing thus separated colored particle in a form of a cake-shaped wet lump called as a toner cake for removing adhering matters such as the surfactant and coagulant.

The washing treatment is carried out until the electroconductivity of the filtrate becomes about 10 μs/cm. As the filtrating method, a centrifugation method, a pressure reducing method using a Nutche funnel and a method using a filter press are applicable though the method is not specifically limited.

(7) Drying Process

In this process, the washed colored particles are dried for obtaining the dried colored particles. As the dryer to be used in the process, a spray dryer, vacuum freezing dryer and reduced pressure dryer are usable and a still rack dryer, a movable rack dryer, fluid layer dryer, rotation dryer and stirring dryer are preferable.

The moisture content of the dried colored particles is preferably not more than 5%, and more preferably not more than 2%, by weight. When the dried colored particles cohere with together by weak inter-particle force, the cohering clod may be crushed. As the crushing machine, a mechanical crusher such as a jet mill, Henschel mixer, coffee mill and food processor can be used.

(8) External Additive Treatment Process

In this process, the toner is produced by adding external additives such as the titanate compound containing ion atoms of from 0.01% to 0.10 and another to the dried colored particles. As the device for mixing the external additive, a mechanical mixer such as a Henschel mixer and coffee mill is applicable.

The toner of the invention can be produced by the above processes.

In the invention, the charging property of the toner can be stably held without any influence of the environmental condition when the toner has an acid value of from 5 KOH mg/g to 30 KOH mg/g. Namely, the toner having the acid value within the above range displays stable charge generation ability and the charge holding ability under a condition in which charge leaking tends to be caused by adsorbing moisture in are onto the toner surface such as high temperature and high humidity condition. Besides, the excessive charging of the toner is prevented by causing charge leaking by the presence of the titanate compound containing iron even when the environmental atmosphere has a condition easily causing excessive charging of the toner such as low temperature and low humidity condition, in such the condition the charge is difficultly leaked since the moisture content in air is low.

As above-mentioned, it is found in the invention that the toner which has an acid value of from 5 KOH mg/g to 30 KOH mg/g, and preferably from 7 KOH mg/g to 25 KOH mg/g, displays suitable charging property. Namely, the charge is held at the designated level in the invention even though leaking of charge caused by moisture adsorption is anxious as to the toner having the acid value within the above range. It is presumed that the charge is easily held by the affect of the high dielectricity of the titanate compound and the leaking is inhibited by the effect of the titanate compound even when the leak tends to be caused by absorbed moisture so that the charging property can be held. Namely, it considered that the titanate compound added as the external additive affects as a carrier and supply charge to the toner. In a environment difficultly causing the leaking of charge such as low temperature and low humidity condition, excessive charge is leaked by the affect of the iron atoms contained in the titanate compound so as to inhibit excessive charging of the toner. In the invention, the charge holding ability of the toner is held in well balance.

The acid value of the toner is determined by the amount of potassium hydroxide in milligram necessary for neutralizing the polar group such as a carboxyl group contained in 1 g of the resin or toner. The acid value of the toner is measured by that the sample is dissolved in a benzene-ethanol mixture solvent and the solution is titrated by a potassium hydroxide solution having a known titer and the acid value is calculated from the amount necessary for neutralization. As concrete measuring method of the acid value of toner, that described in JIS-0070-1992 is cited.

In the case of the resin formed by addition polymerization reaction, the acid value of the toner of the invention can be controlled by the ratio of an acidic component such as an acrylic acid type monomer or the monomer composition on the occasion of the polymerization reaction to product the toner. In the case of the resin formed by a condensation polymerization, the acid value can be controlled by inhibiting the crosslinking reaction by introducing a multifunctional acid such as trimellitic acid, controlling the ratio of the acid component and the alcohol component or varying the polymerization condition.

The resin, colorant and wax each constituting the toner of the invention is described below citing concrete examples.

As the resin usable in the invention, a polymer formed by polymerizing the following polymerizable vinyl type monomer. The polymer constituting the resin usable in the invention is one formed by polymerizing one or more of the polymerizable monomers.

The concrete examples of the polymerizable monomer are listed below.

(1) Derivatives of Styrene or Ethylene

Styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene and p-n-dodecylstyrene (2) Ethacrylate Derivatives Methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate (3) Acrylate Derivatives Methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate and phenyl acrylate (4) Olefins Ethylene, propylene and isobutylene (5) Vinyl Esters Vinyl propionate, vinyl acetate and vinyl benzoate (6) Vinyl Ethers Vinyl methyl ether and vinyl ethyl ether (7) Vinyl Ketones Vinyl methyl ketone, vinyl ethyl ketone and vinyl hexyl ketone (8) N-Vinyl Compounds N-vinylcarbazole, N-vinylindole and N-vinylpyrrolidone (9) Others Vinyl compounds such as vinylnaphthalene and vinylpyridine, and derivatives of acrylic acid and methacrylic acid such as acrylonitrile, methacrylonitrile and acrylamide The toner of the invention is constituted by suitably using the polymerizable monomer having a polar group or a polymerizable monomer having high hyrophophilicity.

A resin having crosslinking structure can be produced by using the following multifunctional vinyl compounds. Concrete examples of the multifunctional vinyl compounds are listed below.

Divinylbenzene, ethyleneglycol dimethacrylate, ethyleneglycol diacrylate, diethyleneglycol dimethacrylate, diethyleneglycol diacrylate, triethyleneglycol dimethacrylate, triethyleneglycol diacrylate, neopentylglycol dimethacrylate and neopentylglycol diacrylate As the colorant usable in the toner of the invention, known colorants are cited. Concrete colorants are listed below.

As the black colorant, carbon black such as furnace black, channel black, acetylene black, thermal black and lamp black and magnetic powders such as magnetite and ferrite are usable.

As magenta and red colorant, C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 123, C.I. Pigment Red 139, C.I. Pigment Red 144, C.I. Pigment Red 149, C.I. Pigment Red 150, C.I. Pigment Red 166, C.I. Pigment Red 177, C.I. Pigment Red 178, C.I. Pigment Red 184, C.I. Pigment Red 238 and C.I. Pigment Red 222 are cited.

As orange or yellow colorant, C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 74, C.I. Pigment Yellow 93, C.I. Pigment Yellow 94, C.I. Pigment Yellow 138, C.I. Pigment Yellow 155 and C.I. Pigment Yellow 180 are cited.

As green or cyan colorant, C.I. Pigment Blue 15, C.I. Pigment Blue 15:2, C.I. Pigment Blue 15:3, C.I. Pigment Blue 15:4, C.I. Pigment Blue 16, C.I. Pigment Blue 60, C.I. Pigment Blue 62, C.I. Pigment Blue 66 and C.I. Pigment Green 7 are cited.

These colorants may be used solely or in combination of two or more kinds of them. The adding amount of the colorant is preferably 1 to 30%, and more preferably 2 to 20%, by weight of the entire toner.

As the wax usable in the toner of the invention, known ones listed below are cited.

(1) Polyolefin Waxes

Polyethylene wax and polypropylene wax (2) Long Chain Hydrocarbon Waxes

Paraffin wax and sasol wax (3) Dialkyl Ketone Type Waxes

Distearyl ketone (4) Ester Type Waxes

Calnauba wax, Montan wax, trimethylolpropane tribehenate, pentaerythrytol tetramyristate, pentaerythrytol tetrastearate, pentaerythrytol tetrabehenate, pentaerythrytol diacetate dibehenate, glycerol tribehenate, 1,18-octadecanediol distearate, tristearyl trimellitate and distearyl maleate (5) Amide Type Waxes Ethylenediaminedibehenylamide and trimellitic tristearylamide The melting point of the waxes is usually from 40 to 125° C., preferably from 50 to 120° C., and more preferably from 60 to 90° C. When the melting point is within the above range, the thermal resistivity during storing can be held and stable image formation can be carried out without occurrence of cold offset even when the fixation is performed at low temperature. The content of the wax is preferably from 1 to 30%, and more preferably from 5 to 20%, by weight.

The toner of the invention may contain an inorganic or organic particle having an average primary diameter of 4 to 800 nm as an external additive additionally to the titanate compound containing 100 to 1,000 ppm of iron.

The kind of external additive is not specifically limited and the following inorganic or organic particle and a slipping agent can be cited.

A known inorganic particle can be used. Concretely, silica and alumina are preferably used. These inorganic particles may be subjected to a hydrophobic treatment according to necessity. As the silica particle, R-805, R-976, R-974, R-972, R-812 and R-809, each manufactured by Nippon Aerosil Co., Ltd., HVK-2150 and H-200, each manufactured by Hoechst GmbH, and Ts-720, TS-530, TS-610, H-5 and MS-5, each manufactured by Cabot Corp., are cited for example; the above products are available on the market.

As the alumina fine particle, RFY-C and C-604, each manufactured by Nippon Aerosil Co., Ltd and TTO-5, manufactured by Ishihara Sangyo Kaisha Ltd., are cited for example. These products are available on the market As the organic fine particle, spherical organic particles having an average primary diameter of from about 10 to 2,000 nm are usable. Concretely, homopolymer of styrene or methylmethacrylate and a copolymer thereof are usable.

Moreover, a metal salt of higher fatty acid so-called as a lubricant agent can be used for further improving the cleaning suitability and transferring ability. Examples of the higher fatty acid salt include a stearate of zinc, aluminum, copper, magnesium or calcium, an oleate of zinc, manganese, iron, copper or magnesium, a parmitate of zinc, copper, magnesium or calcium, a linoleate of zinc or calcium and a ricinoleate of zinc or calcium.

The adding amount of such the external additives is preferably 0.1 to 10.0% by weight, including the foregoing titanate compound containing iron, of the entire toner. As the method for adding the external additives, a method using a tabular mixer, a Henschel mixer, nauta mixer or a V-mixer is applicable.

The toner of the invention can be used as a single-component developer or a double-component developer. The toner of the invention can held stable charging property by the effect of the titanate compound containing iron, which is added as the external additive, when the toner is used as the double-component developer by mixing with a magnetic particle carrier. In the image formation by the double-component developer, it is observed that uniformly charging of the toner tends to be difficultly performed when the image formation using a small amount of the toner such as printing of images with low image ratio. The reason of such the phenomenon is considered that the same toner is remains at the charging point of the carrier under the condition of low consumption of the toner and hinders charging of newly supplied toner. The charging can be uniformly performed under such the image formation condition by the double-component developer using the toner of the invention. It is supposed that such the effect can be obtained by that the titanate compounds containing the specified amount of iron being at the toner surface acts as a low resistive component so that the exchanging of the charge between the toner and the carrier is easily performed and the old toner is easily released from the carrier surface.

When the toner of the invention is used as the double-component developer, known materials such as a metal such as iron ferrite and magnetite and an alloy of the above metal and a metal such as aluminum and lead are cited as the usable carrier. Among them, the ferrite particle is preferred. The volume average particle diameter of the carrier is preferably from 15 to 100 μm and more preferably from 25 to 80 μm.

Figure 2:
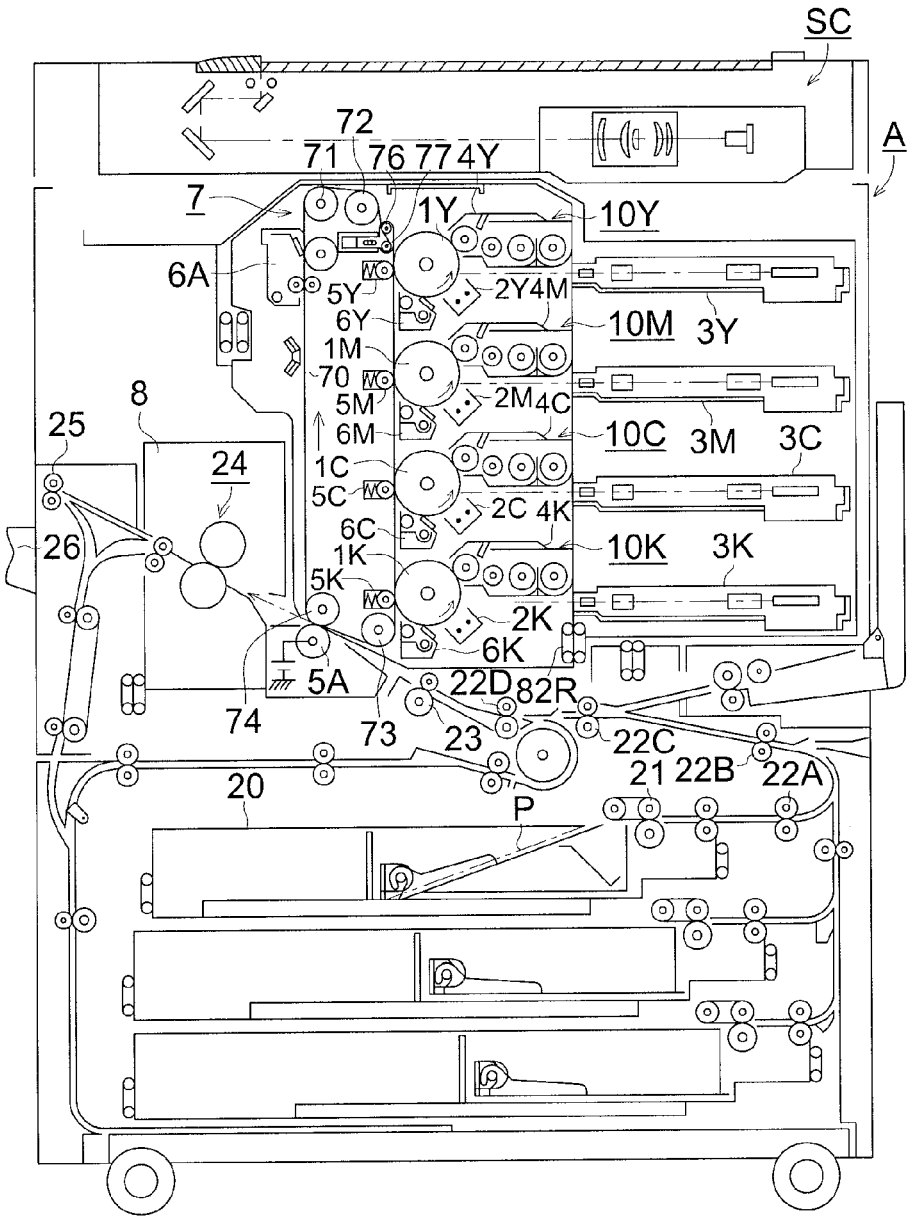
FIG. 2 is a schematic drawing of an example of image forming apparatus corresponding to double-component type developer.

FIG. 2 is a schematic drawing of an example of image forming apparatus usable when the toner of the invention is used as the double-component developer.

In FIG. 2, 1Y, 1M, 1C and 1K are each a photoreceptor, 4Y, 4M, 4C and 4K are each a developing means, 5Y, 5M, 5C and 5K are each a primary transfer roller as a primarily transferring means, 5A is a secondary transfer roller as a secondarily transferring means, 6Y, 6M, 6C and 6K are each a cleaning means, 7 is an intermediate transfer unit, 24 is a roller type fixing device and 70 is an intermediate transfer member.

This image forming apparatus is called as a tandem type color image forming apparatus and has plural image forming units 10Y, 10M, 10C and 10K, an endless belt-shaped intermediate transfer unit 7 as a transferring member, an endless belt-shaped paper conveying means 21 and a heat roller type fixing device 24. An original image reading device CS is arranged at upper portion of the main body A of the image forming apparatus.

The yellow image forming unit 10Y for forming a yellow image, which is one of different color images each formed on the photoreceptors, has the drum-shaped photoreceptor 1Y as a first photoreceptor, a charging means 2Y arranged around the photoreceptor 1Y, an exposure means 3Y, the developing means 4Y, the primary transfer roller 5Y as the primarily transferring means and the cleaning means 6Y. The magenta image forming unit 10Y for forming a magenta image, which is another one of different color image each formed on the photoreceptors, has the drum-shaped photoreceptor 1M as a first photoreceptor, a charging means 2M arranged around the photoreceptor 1M, an exposure means 3M, the developing means 4M, the primary transfer roller 5M as the primarily transferring means and the cleaning means 6M. The cyan image forming unit 10C for forming a cyan image, which is another one of different colors each formed on the photoreceptors, has the drum-shaped photoreceptor 1C as a first photoreceptor, a charging means 2C arranged around the photoreceptor 1C, an exposure means 3C, the developing means 4C, the primary transfer roller 5C as the primarily transferring means and the cleaning means 6C. The black image forming unit 10K for forming a black image, which is another one of different color images each formed on the photoreceptors, has the drum-shaped photoreceptor 1K as a first photoreceptor, a charging means 2K arranged around the photoreceptor 1K, an exposure means 3K, the developing means 4K, the primary transfer roller 5K as the primarily transferring means and the cleaning means 6K.

The endless belt-shaped intermediate transfer unit 7 has a endless belt-shaped intermediate transfer member 70 as the secondary transfer member which is taken around and rotatably supported by plural rollers.

The different color images each formed by the image forming units 10Y, 10M, 10C and 10K, respectively, are successively transferred onto the endless belt-shaped rotating intermediated transfer member 70 by the primary transfer rollers 5Y, 5M, 5C and 5K. Thus a full color image is synthesized. A recording material P such as paper stocked in a paper stocking cassette 20 is supplied by a paper conveying means 21 to the secondary transfer roller 5A as the secondarily transferring means through plural intermediate rollers 22A, 22B, 22C and 22D and a register roller 23. Then the full color image is transferred at once onto the recording material P. The recording material P on which the color image is transferred is fixed by the heating roller fixing device 24 and placed on an output paper tray 26 by holding by a paper taking out roller 25.

On the other hand, the endless belt-shaped intermediate transfer member 70 is subjected to cleaning for removing the toner remaining thereon after transferring the color image onto the recording material P by the secondary transfer roller 5A and releasing the recording material P by the curvature difference.

The primary transfer roller 5K is continuously contacted by pressure to the photoreceptor 1K during the image formation treatment. The other primary transfer rollers 5Y, 5M and 5C are contacted to the corresponding photoreceptors 1Y, 1M and 1C, respectively, only when the color image formation.

The secondary transfer roller 5A is contacted by pressure to the endless belt-shaped intermediate transfer member 70 only when the recording material P is passed for carrying out the secondary transfer.

A case 8 is capable of pulling out from the main body A through supporting rails 82L and 82R.

The case 8 contains the image forming units 10Y, 10M, 10C and 10K and the endless belt-shaped intermediate transfer unit 7.

The image forming units 10Y, 10M, 10C and 10K are arranged in series in the vertical direction. The endless belt-shaped intermediate transfer unit 7 is arranged on the left side in the drawing of the photoreceptors 1Y, 1M, 1C and 1K. The endless belt-shaped intermediate transfer unit 7 is composed of the rotatable endless belt-shaped intermediate transfer member 70 which is rounded through the rollers 71, 72, 73, 74 and 76, the primary transfer rollers 5Y, 5M, 5C and 5K and the cleaning means 6A.

The image forming units 10Y, 10M, 10C and 10K and the endless belt-shaped intermediate transfer unit 7 are pulled out as one from the main body A by pulling out the case 8.

As above-mentioned, the toner images are formed on the photoreceptors 1Y, 1M, 1C and 1K by the charging, exposing and development, overlapped on the endless belt-shaped intermediate transfer member 70, transferred at once onto the recording material P and fixed by pressing and heating by the fixing device 24. The photoreceptors 1Y, 1M, 1C and 1K are cleaned for removing the toner remaining by the cleaning device 6A after transferring the toner image to the recording material P. After that, the cycle of charging, exposing and developing is repeated for next image formation.

The toner of the invention can be also used as the single-component using no carrier. As the single-component type developer, a magnetic single-component developer containing magnetic particles of 0.1 to 0.5 μm is cited additionally to a non-magnetic single-component developer. The image formation by the single-component developing system contributes for making compact the apparatus since a developing device having simple constitution using smaller number of parts compared with the image formation by the double-component developing system is used in such the system. Such the system is particularly preferable for the single-component full color image forming apparatus in which the developing devices for each of the colors of yellow magenta, cyan and black are arranged in a limited space. Particularly, full color images having suitable colors can be stably formed when the toner of the invention is used as the non-magnetic single-component developer.

Figure 3:
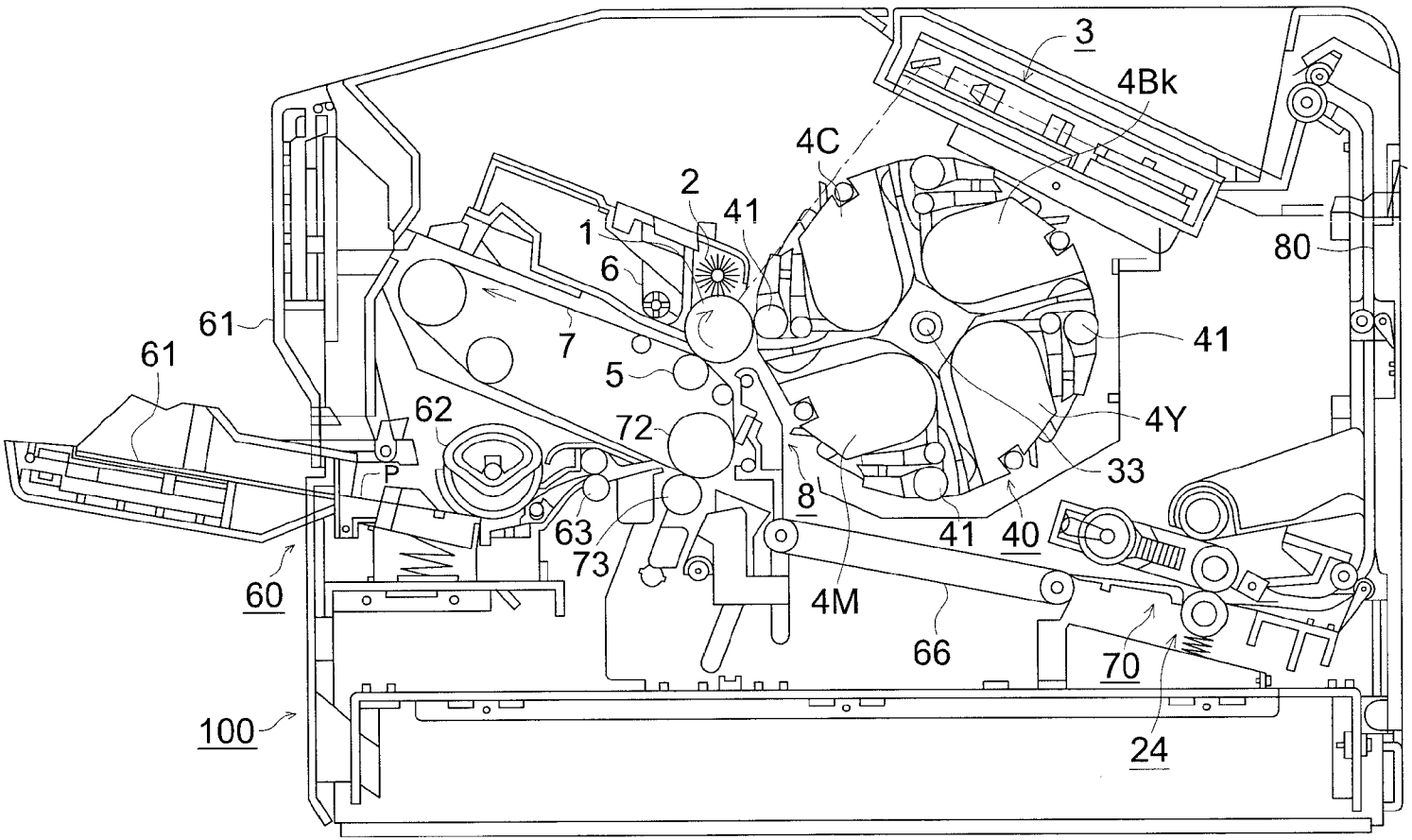
FIG. 3 is a schematic drawing of an example of image forming apparatus corresponding to non-magnetic single-component type developer.

FIG. 3 displays an example of full color image forming apparatus using the non-magnetic single-component developer. The image forming apparatus 100 shown in FIG. 3 is a typical one in which the developing device shown in FIG. 4 can be installed. In the image forming apparatus shown in FIG. 3, a charging brush 2 for uniformly giving designated charging to the surface of the static latent image carrier 1, hereinafter also referred to photoreceptor drum, a cleaner 6 for removing the toner remaining on the photoreceptor drum 1 are arranged around the photoreceptor drum 1.

The photoreceptor drum uniformly charged by the charging brush 2 is exposed by a laser scanning optical system 3 to form a static image on the photoreceptor drum 1. The laser scanning optical system 3 includes a laser diode, a polygon mirror and an fθ optical element, and the printing data of each of yellow, magenta, cyan and black images are transferred to the controller of the system. The laser beam is successively output according to the above printing data of each of the colors for scanning the photoreceptor drum surface to form static latent image of each of the colors.

A developing device unit 40 containing the developing device 4 supplies each of the color toners to the photoreceptor for carrying out the development. In the developing device unit 40, four developing devices 4Y, 4M, 4C and 4K each containing yellow, magenta, cyan and black non-magnetic single-component toners, respectively, are arranged around a supporting axis 33. The developing devices 4 are rotated around the supporting axis 33 and introduced to the position facing to the photoreceptor drum 1.

The developing device unit 40 is rotated every time of formation of static latent images of each of the colors on the photoreceptor 1 by the laser scanning optical system 3 so that the developing device containing the toner of corresponding color is introduced at the portion facing to the photoreceptor 1. Then electrically charged toners of each of the colors are successively supplied from each of the developing devices 4Y, 4M, 4C and 4K onto the photoreceptor 1 to carry out the development.

In the image forming apparatus shown in FIG. 3, an endless intermediate transfer belt 7 is provided on the down stream side of the developing device unit 40 in the rotation direction of the photoreceptor drum 1. The intermediate transfer belt 7 is circulated synchronously with the rotation of photoreceptor drum 1. The intermediate transfer belt 7 is contacted with the photoreceptor drum 1 at the point where the belt is pressed by the primary transfer roller 5, and the toner image formed on the photoreceptor drum 1 is transferred onto the intermediate transfer belt 7. A rotatable secondary transfer roller 73 is provided, which is facing to a supporting roller 72 supporting the intermediate transfer belt 7. The toner image placed on the intermediate transfer belt is pressed and transferred onto the recording material P such as recording paper at the portion where the secondary transfer roller 73 is faced to the supporting roller 72.

A cleaner 8 for removing the toner remaining on the intermediate transfer belt 7 is releasably provided between the color developing device unit 40 and the intermediate transfer belt 7.

A paper supplying means 60 for conducting the recording material P to the intermediate transfer belt 7 is composed of a paper supplying tray 6 for stocking the recording material P, a paper supplying roller 62 for supplying the recording material P stocked in the paper supplying tray 61 one by one and a timing roller 63 for conveying the supplied recording material P to the secondary transfer portion.

The recording material P on which the toner image is transferred to a fixing device 24 by a conveying means 66 and the transferred toner image is fixed onto the recording material P. After the fixation, the recording material P is conveyed through a conveying route 80 and taken out onto the upper face of the main body 100.

Figure 4:
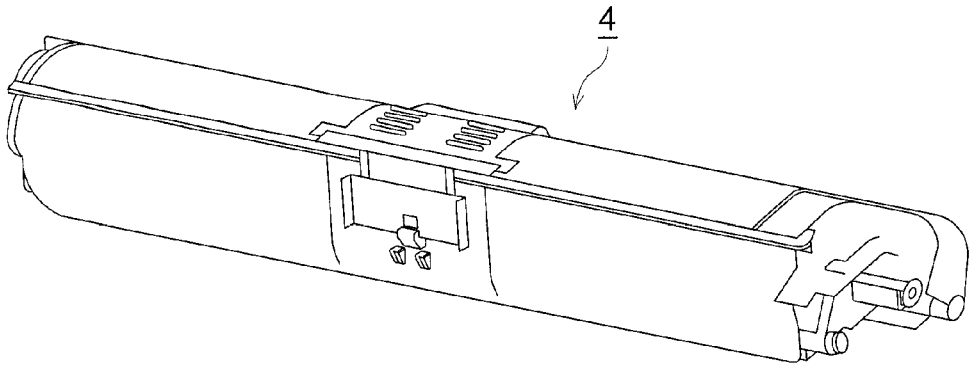
FIG. 4(*a*), (*b*) is a schematic drawing of an example of developing device (toner cartridge)
Figure 4:
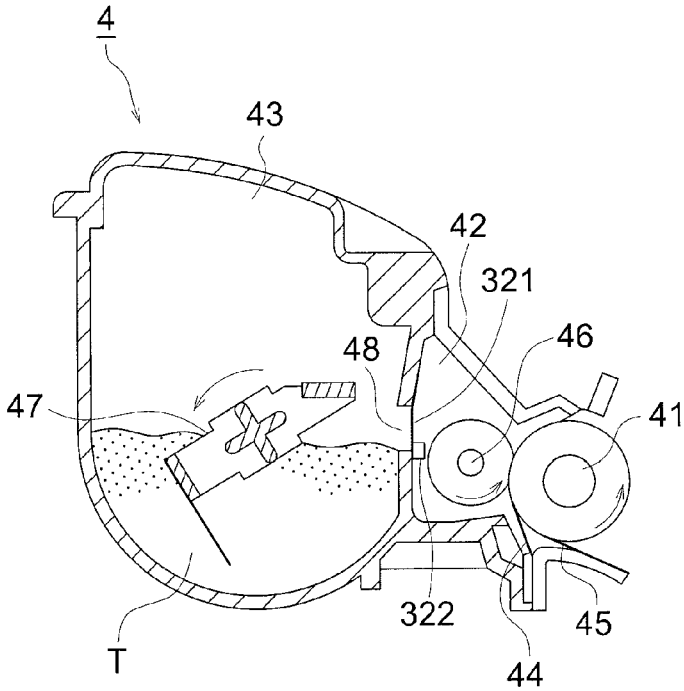

The changeable developing device 4 shown in FIG. 4 is installed in the image forming apparatus shown in FIG. 3 for image formation. The developing device 4 shown in FIG. 4*a* is usually called as a toner cartridge, in which designated parts such as a developing roller are arranged and a designated amount of the developer is charged. The developing device supplied in the form of toner cartridge is installed at the designated position of the image forming apparatus and then supplying the developer charged in the cartridge to the photoreceptor drum for carrying out development. The toner cartridge is taken off from the apparatus when the developer is used up by carrying out the designated number of image formation, and a new cartridge is installed.

FIG. 4*a* shows a schematic cross section of the developing device 4 which is also referred to as the toner cartridge 4. The toner cartridge 4 has a buffer chamber 42 adjacent to a developing roller 41 and a hopper 43 adjacent to the buffer chamber 42.

The developing roller 41 has an electroconductive columnar substrate and an elastic layer of a material having high hardness such as silicone rubber formed on the outside of the columnar substrate.

In the buffer chamber 42, a blade 44 as a toner regulating member is arranged in a contacted state to the developing roller 4. The blade 44 regulates the adhering amount and charging amount of the toner on the developing roller 41. An assistance blade 45 for regulating the adhering amount and the charging amount of the toner on the developing roller may be provided on the down stream side to the rotating direction of the developing roller.

A supplying roller 46 is pressed to the developing roller 41. The supplying roller 46 is rotated by driving by a motor not shown in the drawing in the same direction (anticlockwise direction) in the drawing as that of the developing roller 41. The supplying roller has the electroconductive columnar substrate and a foamed layer formed around the substrate by a material such as urethane foam.

The hopper 43 contains toner T of the single-component developer. A rotor 47 for stirring the toner is provided in the hopper 43. The rotor has a conveying film wing and conveys the toner by the rotation thereof in the direction shown in the drawing by the arrow. The toner conveyed by the conveying wings is supplied into the buffer chamber 42 through a pass 48 provided on the partition parting the hopper 43 and the buffer chamber. The shape of the conveying wing is made so that the wing is bent while conveying the toner at the front side of the rotating direction of the wing accompanied with the rotor 47 and returned to straight when arrived at the side end of the pass 48. The wing supplies the toner to the pass 48 by varying the shape thereof from bent state to straight state.

In the pass 48, a valve 321 for closing the pass 48 is provided. The valve 321 is made from film and fixed at the upper portion of right side of the pass 48 of the partition and bent by the pressing to the right side by the pressing force of the toner to open the pass 48 when the toner is supplied from the hopper 43 to the pass 48. As a result of that, the toner is supplied into the buffer chamber 42.

A regulation member 322 is attached at the other end of the valve 321. The regulation member 322 and the supplying roller 46 are arranged so that a slight gap is formed even when the valve 321 closes the pass 48. The regulation member 322 regulates the amount of the toner accumulated at the bottom of the buffer chamber 42 so that the amount is not made excess. The toner recovered from the developing roller to the supplying roller 64 is regulated so that the toner is not excessively fallen to the bottom of the buffer chamber 42.

In the toner cartridge 4, the toner in the buffer chamber 42 is supplied onto the developer roller 41 by rotation of the supplying roller 46 accompanied with rotation of the developer roller 41 in the direction of the arrow on the occasion of the image formation. The toner supplied on the developer roller 41 is conveyed to the zone facing to the image carrier after charging and making into a thin layer by the blade 44 and the assistant blade 45 and served for developing the static latent image carried on the image carrier. The toner not used for the development is returned to the buffer chamber accompanied with the rotation of the developing roller 41 and scraped off by the supplying roller 46 to be recovered.

The toner image formed by the toner of the invention is finally transferred on to the recording material is fixed on the recording material by the fixing treatment to form an image. The recording material P to be used for the image formation is a support for supporting the toner image and usually called as an image support, recording material or transfer paper. Concretely, various recoding materials such as thin to thick usual paper, high quality paper, coated paper for printing such as art paper and coated paper, Japanese paper and postcard paper available on the market, plastic film for OHP are applicable but the material is not limited to the above.

EXAMPLES

The embodiment of the invention is described below referring examples though the invention is not limited to the examples.

1. Preparation of Titanium Oxide 1

The pH of a metatitanic acid dispersion was adjusted to 9.0 by a 4.0 moles/L aqueous solution of potassium hydroxide for a desulphurization treatment and then adjusted to 5.5 by a 6.0 moles/L aqueous solution of hydrochloric acid for neutralization. After that, metatitanic acid is separated form the metatitanic acid dispersion by filtration and washed to prepare a cake. A dispersion having a concentration of 1.25 moles/L in terms of titanium oxide $TiO_2$ was prepared by adding water to the above obtained cake and the pH of the dispersion was adjusted to 1.2 by the 6.0 moles/L hydrochloric acid solution. The temperature of the dispersion was adjusted to 35° C. and stirred for 1 hour at this temperature for deflocculating the metatitanic acid dispersion.

From the above deflocculated titanic acid dispersion, 0.156 moles in terms of $TiO_2$ of metatitanic acid was taken out and put into a reaction vessel. Then an aqueous solution of calcium carbonate $CaCO_3$ and an aqueous solution of ferric chloride were added to the reaction vessel and the titanium oxide concentration in the reaction system was adjusted to 0.156 moles/L. The added amount of the calcium carbonate $CaCO_3$ was 1.15 in a mole ratio to titanium oxide ($CaCO_3/TiO_2$=1.15/1.00) and that of ferric chloride was 0.009 in a mole ratio to titanium oxide ($FeCl_3/TiO_2$=0.009/1.00).

Nitrogen gas was put into the reaction vessel and stood for 20 minutes for making nitrogen atmosphere in the vessel and then the mixture composed of metatitanic acid, calcium carbonate and ferric chloride was heated by 90° C. and an aqueous solution of sodium hydroxide was added spending 24 hours until the pH of the system become 8.0. Thereafter, the reaction system was further stirred for 1 hour at 90° C. and then the reaction was finished.

After the finishing of reaction, the interior of the reaction vessel was cooled by 40° C. and the supernatant was removed under the nitrogen atmosphere and then decanted twice by each adding 2,500 parts by weight of purified water to the reaction vessel. After the decantation, the reaction system was filtered by a Nutsche funnel to prepare a cake. The resultant cake was heated by 110° C. and dried for 8 hours under ordinal atmosphere.

Thus obtained dried calcium titanate was put into an alumina crucible and dehydrated and baked at 930° C. After the baking, the calcium titanate was put into water and subjected to wet crushing treatment by a sand grinder to prepare dispersion. The pH of the resultant dispersion was adjusted to 2.0 by adding the 6.0 mole/L aqueous solution of hydrochloric acid for removing excessive calcium. Thereafter, the calcium titanate was subjected to a wet type hydrophobilizing treatment using silicone oil emulsion (dimethylpolysiloxane type emulsion) SM7036EX, manufactured by Toray Dow Corning Silicone Co., Ltd. The hydrophobilizing treatment was carried out by adding the silicone oil emulsion in an amount of 0.7 parts by weight to 100 parts by weight of the solid component of calcium titanate and stirring for 30 minutes.

After the wet type hydrophobilizing treatment, the pH of the dispersion was neutralized to 6.5 by adding a 4.0 moles/L aqueous solution of sodium hydroxide, filtered and washed and then dried at 150° C. After that, the dried matter was crushed for 60 minutes by a mechanical crusher. Thus, calcium titanate containing iron atoms "Titanate Compound 1" was prepared.

The iron content of Titanate Compound 1 measured by the inductively coupled plasma emission spectrometry was 102 ppm. The volume average particle diameter, standard deviation of particle diameter (SD value) and BET specific surface area measured foregoing methods were each 205 nm, 110 nm and 16.3 $m^2/g$, respectively.

(2) Preparation or Titanate Compounds 2 to 7

Titanate Compounds 2 to 7 were prepared in the same manner as in Titanate Compound 1 except that the adding mole ratio of ferric chloride $FeCl_3$ to the titanium oxide was varied as shown in Table 1. Thus obtained results are listed in Table 1.

(3) Preparation of Titanate Compounds 8 to 12

Titanate Compounds 8 was prepared in the same procedure as in Titanate Compound 2 except that the time for deflocculation at 35° C. was prolonged by 90 minutes and the crashing treatment by the mechanical crusher was prolonged by 90 minutes. Titanate Compounds 9 was prepared in the same procedure as in Titanate Compound 2 except that the time for deflocculation at 35° C. was prolonged by 90 minutes.

Titanate Compounds 10 was prepared in the same procedure as in Titanate Compound 2 except that the time for deflocculation at 35° C. was changed to 50 minutes and the crashing treatment by the mechanical crusher was changed to minutes. Titanate Compounds 11 was prepared in the same procedure as in Titanate Compound 2 except that the time for deflocculation at 35° C. was shortened by 20 minutes and the crashing treatment by the mechanical crusher was shortened by minutes. Titanate Compounds 12 was prepared in the same procedure as in Titanate Compound 2 except that the time for deflocculation at 35° C. was shortened by 15 minutes and the crashing treatment by the mechanical crusher was shortened by minutes.

(4) Preparation of Titanate Compounds 13 to 18

Titanium Compound 13 composed of strontium titanate was prepared in the same procedure as in Titanate Compound 2 except that calcium carbonate was replaced by strontium carbonate. Titanium Compound 14 composed of strontium titanate was prepared in the same procedure as in Titanate Compound 4 except that calcium carbonate was replaced by strontium carbonate.

Titanium Compound 15 composed of magnesium carbonate was prepared in the same procedure as in Titanate Compound 2 except that calcium carbonate was replaced by magnesium carbonate. Titanium Compound 16 composed of magnesium titanate was prepared in the same procedure as in Titanate Compound 4 except that calcium carbonate was replaced by magnesium carbonate.

Titanium Compound 17 composed of barium titanate was prepared in the same procedure as in Titanate Compound 2 except that calcium carbonate was replaced by barium carbonate. Titanium Compound 18 composed of barium titanate was prepared in the same procedure as in Titanate Compound 4 except that calcium carbonate was replaced by barium carbonate.

The iron content, number average particle diameter, standard deviation of particle diameter and BET specific surface area of each of Titanate Compounds 1 to 18 are listed in Table 1.

TABLE 1

| | | Adding condition of iron | | Physical properties of titanate compound | | |
|---|---|---|---|---|---|---|
| Titanate Compound No. | Kind of metal atom | Adding amount of $FeCl_3$ (Moles) | Iron content (ppm) | Number average particle diameter (nm) | Standard deviation of particle diameter (nm) | BET specific surface area ($m^2/g$) |
| 1 | Calcium | 0.009 | 102 | 207 | 111 | 16.0 |
| 2 | Calcium | 0.030 | 400 | 205 | 110 | 16.3 |
| 3 | Calcium | 0.076 | 900 | 200 | 100 | 16.0 |
| 4 | Calcium | 0 | 0 | 207 | 111 | 16.3 |
| 5 | Calcium | 0.006 | 80 | 210 | 118 | 17.1 |
| 6 | Calcium | 0.075 | 1010 | 207 | 118 | 16.5 |
| 7 | Calcium | 0.086 | 1102 | 203 | 121 | 16.1 |
| 8 | Calcium | 0.030 | 440 | 35 | 88 | 35.5 |
| 9 | Calcium | 0.030 | 420 | 50 | 250 | 23.8 |
| 10 | Calcium | 0.030 | 400 | 400 | 202 | 9.8 |
| 11 | Calcium | 0.030 | 410 | 2000 | 330 | 5.0 |
| 12 | Calcium | 0.030 | 430 | 2800 | 400 | 3.5 |
| 13 | Strontium | 0.030 | 450 | 240 | 222 | 3.2 |
| 14 | Strontium | 0 | 0 | 239 | 220 | 3.6 |
| 15 | Magnesium | 0.030 | 440 | 226 | 139 | 18.1 |
| 16 | Magnesium | 0 | 0 | 225 | 140 | 18.4 |
| 17 | Barium | 0.030 | 500 | 95 | 90 | 19.6 |
| 18 | Barium | 0 | 0 | 97 | 91 | 19.7 |

2. Preparation of Colored Particles A to E 2.1 Preparation of Colored Particle A (1) Preparation of Resin Particle H In a reaction vessel on which a stirrer, a thermal sensor, a cooler and a nitrogen introducing device were attached, a surfactant solution (an aqueous medium) was prepared by dissolving 7.08 parts by weight of a surfactant of sodium laurylsulfate in 3010 parts by weight of deionized water. The internal temperature of the vessel was raised by 80° C. by stirring resultant surfactant solution at a stirring rate of 230 rpm under a nitrogen atmosphere.

To the surfactant solution, a polymerization initiator solution prepared by dissolving 9.2 parts by weight of polymerization initiator of potassium persulfate (KPS) in 200 parts by weight of deionized water is added and the internal temperature of the reaction vessel was adjusted to 75° C. Then Mixture Liquid 1A composed by the following compounds was dropped spending 1 hour.

| | |
|---|---|
| Styrene | 69.4 parts by weight |
| n-Butyl acrylate | 28.3 parts by weight |
| Methacrylic acid | 2.3 parts by weight |

Polymerization was carried out by stirring for 2 hours at 75° C. to prepare Resin Particle Dispersion 1H.

(2) Preparation of Resin Particle 1HM

The following compounds were put into a flask on which a stirrer was attached.

| | |
|---|---|
| Styrene | 97.1 parts by weight |
| n-Butyl acrylate | 39.7 parts by weight |
| Methacrylic acid | 3.22 parts by weight |

-continued

| | |
|---|---|
| n-Octyl 3-mercaptopropionate | 5.6 parts by weight |
| Pentaerythrytol tetrabehenate | 98.0 parts by weight |

Pentaerythrytol tetrabehenate was dissolved in the resultant composition by heating at 90° C. to prepare Mixture Liquid 1B composed of the above compounds.

Besides, in a reaction vessel on which a stirrer, a thermal sensor, a cooler and a nitrogen introducing device were attached, a surfactant solution (an aqueous medium) was prepared by dissolving 1.6 parts by weight of a surfactant of sodium laurylsulfate in 2700 parts by weight of deionized water and heated by 98° C. The foregoing Resin Particle Dispersion 1H in an amount of 28 parts by weight in terms of solid component was added to the surfactant solution and then the foregoing Mixture Liquid B was added. The resultant mixture was dispersed for 8 hours by a mechanical dispersing machine having a circulation pass Clearmix, manufactured by M-Technique Co., Ltd., to prepare a dispersion (emulsion).

An initiator solution prepared by dissolving 5.1 parts by weight of potassium persulfate (KPS) in 240 parts by weight of deionized water and 750 parts by weight of deionized water was added to the above dispersion (emulsion). Polymerization was carried out by stirring for 12 hours at 98° C. Thus a dispersion of Resin Particle 1HM was prepared which had a composite structure in which the surface of Resin Particle 1H was covered with a resin layer.

(3) Preparation of Resin Particle 1HML

An initiator solution prepared by dissolving 7.4 parts by weight of potassium persulfate (KPS) in 200 parts by weight of deionized water was added to Resin Particle 1HM and the temperature was adjusted to 80° C. Then Mixture Liquid 1C composed of the following compounds was dropped spending 1 hour into the above system.

| | |
|---|---|
| Styrene | 277 parts by weight |
| n-Butyl acrylate | 113 parts by weight |
| Methacrylic acid | 9.21 parts by weight |
| n-Octyl 3-mercaptopropionate | 10.4 parts by weight |

After completion of dropping, the reaction system was heated and stirred at the above temperature for 2 hours for performing polymerization and then cooled by 28° C. Thus a dispersion of Resin Particle 1HML having a composite structure composed of Resin Particle 1HM covered by a resin layer.

Preparation of Colorant Dispersion 1Bk

To 1,600 parts by weight of deionized water, 90 parts by weight of anionic surfactant sodium laurylsulfate was added and stirred to prepare a surfactant solution. To the above surfactant solution, the following carbon black as a colorant was gradually added while stirring.

| | |
|---|---|
| Regal 330R (Cabot Corp.) | 400 parts by weight |

After the addition of the carbon black, the carbon black was dispersed by the mechanical dispersing apparatus Clearmix, manufactured by M-Technique Co., Ltd., until the particle size become 200 nm to prepare Colorant Dispersion 1Bk.

(5) Preparation of Colored Particle A (Coagulation and Fusion)

The followings were put into a vessel on which a stirrer, thermal sensor, cooler, and nitrogen introducing device were attached and the internal temperature of the vessel was adjusted to 30° C. and the pH of the liquid was adjusted to 10.6 by adding a 5 moles/L sodium hydroxide aqueous solution.

| | | |
|---|---|---|
| Resin Particle Dispersion 1HML | 200 | parts by weight in terms of solid component |
| Deionized water | 3,000 | parts by weight |
| Colorant Dispersion 1 Bk | 71 | parts by weight in terms of solid component |

After the adjustment, an aqueous solution composed of 52.6 parts by weight of magnesium chloride hexahydrate dissolved in 72 parts by weight of deionized water was added to the reaction system spending 10 minutes at 30° C. while stirring and then the reaction system was stood for 3 minutes.

After that, the temperature of the system was raised by 75° C. spending 60 minutes for beginning coagulation of the particles. The coagulation was continued while measuring the diameter of the coagulated particles.

Growing of the particle was stopped by adding an aqueous solution composed of 115 parts by weight of sodium chloride and 700 parts by weight of deionized water when the volume-based median diameter of the coagulated particle become 6.5 μm. Moreover, the system was ripened by raising the temperature by 90° C. and stirring for 6 hours for continuing the fusion of the particles. After that, the system was cooled by 30° C. and the pH was adjusted to 2.0 by adding hydrochloric acid and then the stirring was stopped.

The colored particles prepared by the coagulation and fusion were separated from the mother liquid and repeatedly washed by deionized water of 45° C. and dried by air heated at 40° C. to prepare Colored Particle A. The acid value of Colored Particle A measured by the method described in JIS-0070-1992 was 15.

2-1. Preparation of Colored Particle B (1) Preparation of Resin Particle 2H

Resin Particle Dispersion 2H was prepared in the same manner as in Resin Particle 1H except that Mixture Liquid 1A was replaced by the following Mixture Liquid 2A.

| | |
|---|---|
| Styrene | 70.3 parts by weight |
| n-Butyl acrylate | 28.7 parts by weight |
| Methacrylic acid | 1.0 parts by weight |

(2) Preparation of Resin Particle 2HM (Second Polymerization Step)

Resin Particle Dispersion 2HM was prepared in the same manner as in Resin Particle 1HM except that Mixture Liquid 1B was replaced by Mixture Liquid 2B composed of the following compounds.

| | |
|---|---|
| Styrene | 98.3 parts by weight |
| n-Butyl acrylate | 40.2 parts by weight |
| Methacrylic acid | 1.51 parts by weight |
| n-Octyl 3-mercatopropionate | 5.6 parts by weight |
| Pentaerythrytol tetrabehenate | 98 parts by weight |

(3) Preparation of Resin Particle 2HML

Resin Particle Dispersion 2HML was prepared in the same manner as in Resin Particle 1HML except that Mixture Liquid 1C was replaced by Mixture Liquid 2C composed of the following compounds.

| | |
|---|---|
| Styrene | 283 parts by weight |
| n-Butyl acrylate | 115 parts by weight |
| Methacrylic acid | 4.3 parts by weight |
| n-Octyl 3-mercatopropionate | 10.4 parts by weight |

(4) Preparation of Colored Particle B

Colored Particle B having an acid value of 7.0 was prepared in the same procedure as in Resin Particle A except that Resin Particle Dispersion 1HML was replaced by Resin Particle Dispersion 2HML.

2-3. Preparation of Colored Particle C (1) Preparation of Resin Particle 3H

Resin Particle 3H was prepared in the same procedure as in Resin Particle 1H except that Mixture Liquid 1A was replaced by Mixture Liquid 3A composed of the following compounds.

| | |
|---|---|
| Styrene | 74.5 parts by weight |
| n-Butyl acrylate | 21.6 parts by weight |
| Methacrylic acid | 1.93 parts by weight |

(2) Preparation of Resin Particle 3HM

Resin Particle 3HM was prepared in the same procedure as in Resin Particle 1HM except that Mixture Liquid 1B was replaced by Mixture Liquid 3B composed of the following compounds.

| | |
|---|---|
| Styrene | 104 parts by weight |
| n-Butyl acrylate | 30.2 parts by weight |
| Methacrylic acid | 2.7 parts by weight |
| n-Octyl 3-mercatopropionate | 5.6 parts by weight |
| Pentaerythrytol tetrabehenate | 98 parts by weight |

(3) Preparation of Resin Particle 3HML

Resin Particle 3HML was prepared in the same procedure as in Resin Particle 1HML except that Mixture Liquid 1C was replaced by Mixture Liquid 3C composed of the following compounds.

| | |
|---|---|
| Styrene | 306 parts by weight |
| n-Butyl acrylate | 88.5 parts by weight |
| Methacrylic acid | 17.4 parts by weight |
| n-Octyl 3-mercatopropionate | 10.4 parts by weight |

(4) Preparation of Colored Particle C

Colored Particle C having an acid value of 25 was prepared in the same procedure as in Resin Particle A except that Resin Particle Dispersion 1HML was replaced by Resin Particle Dispersion 3HML.

2-4. Preparation of Colored Particle D (1) Preparation of Resin particle 4H

Resin Particle 4H was prepared in the same procedure as in Resin Particle 1H except that Mixture Liquid 1A was replaced by Mixture Liquid 4A composed of the following compounds.

| | |
|---|---|
| Styrene | 70.7 parts by weight |
| n-Butyl acrylate | 28.9 parts by weight |
| Methacrylic acid | 0.386 parts by weight |

(2) Preparation of Resin Particle 4HM

Resin Particle 4HM was prepared in the same procedure as in Resin Particle 1HM except that Mixture Liquid 1B was replaced by Mixture Liquid 4B composed of the following compounds.

| | |
|---|---|
| Styrene | 99 parts by weight |
| n-Butyl acrylate | 40.4 parts by weight |
| Methacrylic acid | 0.54 parts by weight |
| n-Octyl 3-mercatopropionate | 5.6 parts by weight |
| Pentaerythrytol tetrabehenate | 98 parts by weight |

(3) Preparation of Resin Particle 4HML

Resin Particle 4HML was prepared in the same procedure as in Resin Particle 1HML except that Mixture Liquid 1C was replaced by Mixture Liquid 4C composed of the following compounds.

| | |
|---|---|
| Styrene | 281 parts by weight |
| n-Butyl acrylate | 114.8 parts by weight |
| Methacrylic acid | 1.54 parts by weight |
| n-Octyl 3-mercatopropionate | 10.4 parts by weight |

(4) Preparation of Colored Particle D

Colored Particle D having an acid value of 3 was prepared in the same procedure as in Resin Particle A except that Resin Particle Dispersion 1HML was replaced by Resin Particle Dispersion 4HML.

2-5. Preparation of Colored Particle E (1) Preparation of Resin Particle 5H

Resin Particle 5H was prepared in the same procedure as in Resin Particle 1H except that Mixture Liquid 1A was replaced by Mixture Liquid 5A composed of the following compounds.

| | |
|---|---|
| Styrene | 67.8 parts by weight |
| n-Butyl acrylate | 27.7 parts by weight |
| Methacrylic acid | 4.5 parts by weight |

(2) Preparation of Resin Particle 5HM

Resin Particle 5HM was prepared in the same procedure as in Resin Particle 1HM except that Mixture Liquid 1B was replaced by Mixture Liquid 5B composed of the following compounds.

| | |
|---|---|
| Styrene | 94.1 parts by weight |
| n-Butyl acrylate | 38.4 parts by weight |
| Methacrylic acid | 7.53 parts by weight |
| n-Octyl 3-mercatopropionate | 5.6 parts by weight |
| Pentaerythrytol tetrabehenate | 98 parts by weight |

(3) Preparation of Resin Particle 5HML

Resin Particle 5HML was prepared in the same procedure as in Resin Particle 1HML except that Mixture Liquid 1C was replaced by Mixture Liquid 5C composed of the following compounds.

| | |
|---|---|
| Styrene | 269 parts by weight |
| n-Butyl acrylate | 110 parts by weight |
| Methacrylic acid | 21.5 parts by weight |
| n-Octyl 3-mercatopropionate | 10.4 parts by weight |

(4) Preparation of Colored Particle E

Colored Particle C having an acid value of 35 was prepared in the same procedure as in Resin Particle A except that Resin Particle Dispersion 1HML was replaced by Resin Particle Dispersion 5HML.

3. Preparation of Toners 1 to 21

(1) Preparation of Toner 1

The followings were added as external additives to 100 parts by weight of Colored Particle A.

| | |
|---|---|
| Titanate Compound 1 | 2.0 parts by weight |
| Hydrophobic silica TG-811F (Cabosil) | 1.0 part by weight |
| NX90 (Nippon Aerosil) | 1.0 pat by weight |

Treatment for the external additives was carried out at a circumference speed of stirring wing of 35 m/sec for 60 minutes at 30° C. by using a Henschel mixer FM10B, manufactured by Mitsui Miike Kakou Co., Ltd. And then the particles were put through a sieve with opening of 45 μm for removing coarse particles. Thus Toner 1 was prepared.

(2) Preparation of Toners 2 to 22

Toners 2 to 22 were prepared by combining the kind of the colored particle and kind or adding amount of the titanate compound as shown in Table 2.

TABLE 2

| | Colored particle | | Titanate compound | | |
|---|---|---|---|---|---|
| Toner No. | No. | Acid value | No. | Iron content (ppm) | Adding amount (Parts by weight) |
| 1 | A | 15 | 1 | 102 | 2.0 |
| 2 | A | 15 | 2 | 400 | 2.0 |
| 3 | A | 15 | 3 | 900 | 2.0 |
| 4 | A | 15 | 4 | 0 | 2.0 |
| 5 | A | 15 | 5 | 80 | 2.0 |
| 6 | A | 15 | 6 | 1010 | 2.0 |
| 7 | A | 15 | 7 | 1102 | 2.0 |
| 8 | A | 15 | 8 | 440 | 2.0 |
| 9 | A | 15 | 9 | 420 | 2.0 |
| 10 | A | 15 | 10 | 400 | 2.0 |
| 11 | A | 15 | 11 | 410 | 2.0 |
| 12 | A | 15 | 12 | 430 | 2.0 |
| 13 | A | 15 | 13 | 450 | 2.0 |
| 14 | A | 15 | 14 | 0 | 2.0 |
| 15 | A | 15 | 15 | 440 | 2.0 |
| 16 | A | 15 | 16 | 0 | 2.0 |
| 17 | A | 15 | 17 | 500 | 2.0 |
| 18 | A | 15 | 18 | 0 | 2.0 |
| 19 | B | 7 | 2 | 400 | 2.0 |
| 20 | C | 25 | 2 | 400 | 2.0 |
| 21 | D | 3 | 2 | 400 | 2.0 |
| 22 | E | 35 | 2 | 400 | 2.0 |

4. Evaluation Experiments

The properties of Toners 1 to 22 were evaluated by performing printing under conditions of high temperature-high humidity and low temperature-low humidity. Each of Toner 1 to 22 was charged in an image forming apparatus available on the market for non-magnetic single-component developer and stood for 24 hours under a high temperature-high humidity condition (30° C., 85% RH) and continuous printing of 3,000 sheets was carried out under the same condition and then the image quality after the continuous printing was evaluated.

Besides, each of Toner 1 to 22 was charged in an image forming apparatus available on the market and stood for 24 hours under a low temperature-low humidity condition (1° C., 15% RH) and continuous printing of 3,000 sheets was carried out under the same condition and then the image quality after the continuous printing was evaluated.

In the continuous printing, an A-size original image containing fine line image including images of 4 lines/mm, 5 lines/mm and 6 lines/mm, a halftone image having an image density of 0.40, a white area and a solid black image having an image density of 1.30 each occupying a quarter of the original image was copied.

The evaluation was performed as to the fog on the photoreceptor and the image and variation of the image density. A non-magnetic single-component developing type full color printer Magiclor 2300DL, manufactured by Konica Minolta Business Technologies inc., was used as the image forming apparatus available on the market for the evaluation.

<Fogging on Photoreceptor>

The fog formed on the photoreceptor was evaluated by visual observation after the 3,000 sheets printing. And then a book tape Animety B Coat T, manufactured by Kihara Corp., having a width of 30 mm was pasted to and peeled off from the photoreceptor surface and the peeled tape was pasted onto white paper and visually observed.

The evaluation was carried out according the following four ranking and the samples ranked into A to C were judged as acceptable.

A: Any fogging was not observed either on the photoreceptor or on the peeled tape.

B: Fogging was slightly observed on the photoreceptor but not observed on the peeled tape.

C: Fogging was locally observed on the photoreceptor but the fog is judged that not problem was caused in practical use from the state of the peeled tape.

D: Fogging was observed on entire surface of the photoreceptor and the fog is judged that a problem was caused in practical use from the state of the peeled tape.

(Fogging on Image)

Densities at 20 points on the white area of the image printed at the initial time of starting the continuous printing were measured by a reflective densitometer RD-198, manufactured by Macbeth, and the average of the densities was determined as the white background density. The densities at 20 point on the white background of the 3,000$^{th}$ printed image were measured in the same manner as above and the average of the densities was determined as the white background density of the 3,000$^{th}$ print. The difference of the white background density of the initial print and that of the 3,00$^{th}$ print is defined as the fog density. The sample giving a fog density of less than 0.010 is judged as acceptable and that giving a fog density of less than 0.003 was judged as excellent and that showing a fog density of from 0.03 to 0.006 was judged as good.

(Image Density)

Densities of the solid image on the initial and 3,000$^{th}$ prints were measured for evaluation. Concretely, the densities at any 12 points on each of the solid images of the initial and 3,000$^{th}$ prints were measured by the reflective densitometer RD-918, manufactured by Macbeth, and the average of the measured value was determined as the image density. And then the difference of the image density of the initial print and that of the 3,000$^{th}$ print was calculated for evaluation. The sample showing the difference of the image densities of less than 0.04 was judged as acceptable and that showing the density difference of less than 0.01 was judged as excellent.

Thus obtained results are listed in Table 3.

TABLE 3

| | | High temperature-high humidity condition (30° C., 80% HR) | | | Low temperature-low humidity condition (10° C., 15% HR) | | |
|---|---|---|---|---|---|---|---|
| | Toner No. | Fog (On photo-re-ceptor) | Fog (On image) | Image density | Fog (On photo-re-ceptor) | Fog (On image) | Im-age den-sity |
| Example 1 | 1 | A | 0.002 | 0.00 | A | 0.001 | 0.01 |
| Example 2 | 2 | A | 0.001 | 0.01 | A | 0.001 | 0.01 |
| Example 3 | 3 | A | 0.002 | 0.01 | A | 0.003 | 0.01 |
| Example 4 | 8 | B | 0.004 | 0.03 | C | 0.005 | 0.02 |
| Example 5 | 9 | A | 0.002 | 0.01 | A | 0.003 | 0.01 |
| Example 6 | 10 | A | 0.003 | 0.02 | A | 0.002 | 0.01 |
| Example 7 | 11 | A | 0.004 | 0.03 | B | 0.004 | 0.02 |
| Example 8 | 12 | B | 0.004 | 0.02 | C | 0.007 | 0.03 |
| Example 9 | 13 | C | 0.006 | 0.03 | C | 0.000 | 0.04 |
| Example 10 | 15 | A | 0.001 | 0.00 | A | 0.001 | 0.00 |
| Example 11 | 17 | B | 0.004 | 0.02 | A | 0.003 | 0.03 |
| Example 12 | 19 | A | 0.002 | 0.01 | A | 0.003 | 0.01 |
| Example 13 | 20 | A | 0.003 | 0.00 | A | 0.002 | 0.00 |
| Example 14 | 21 | C | 0.006 | 0.03 | C | 0.008 | 0.04 |
| Example 15 | 22 | C | 0.008 | 0.04 | B | 0.006 | 0.04 |
| Comp. 1 | 4 | C | 0.007 | 0.04 | D | 0.009 | 0.06 |
| Comp. 2 | 5 | C | 0.008 | 0.06 | D | 0.010 | 0.07 |
| Comp. 3 | 6 | D | 0.013 | 0.06 | C | 0.008 | 0.04 |
| Comp. 4 | 7 | D | 0.016 | 0.08 | C | 0.007 | 0.04 |
| Comp. 5 | 14 | C | 0.008 | 0.04 | D | 0.016 | 0.07 |
| Comp. 6 | 16 | C | 0.008 | 0.04 | D | 0.011 | 0.06 |
| Comp. 7 | 18 | C | 0.007 | 0.04 | D | 0.010 | 0.05 |

Comp.: Comparative example

As is displayed in FIG. 3, stable images without causing the problems of fogging and the variation of image density can be obtained in Examples 1 to 15 using the toners satisfying the constitution conditions of the invention under either the high temperature-high humidity or the low-temperature-low humidity condition. It is judged from such the results that the toners of Examples 1 to 15 displays stable charging property under the high temperature-high humidity and low temperature-low humidity conditions. Particularly, the toners using calcium titanate or magnesium titanate tend to display more excellent effects.

On the other hand, in Comparative Examples 1 to 6, any one of the fogging on photoreceptor or image and the image density is not satisfied and it is found that the stable charging property cannot be obtained under the high temperature-high humidity and low temperature-low humidity conditions.

What is claimed is:

1. A toner comprising:

(a) a particle comprising a resin and a colorant; and (b) a titanate compound on a surface of the particle, wherein the titanate compound contains iron in an amount of from 100 ppm to 1,000 ppm.

2. The toner of claim 1, wherein the titanate compound is calcium titanate or strontium titanate.

3. The toner of claim 1, wherein the titanate compound has a BET specific surface area of from 5 $m^2/g$ to 25 $m^2/g$.

4. The toner of claim 1, wherein the titanate compound has a number average particle diameter of from 50 nm to 2,000 nm and a standard deviation of a particle diameter of not more than 250 nm.

5. The toner of claim 1, wherein an amount of the titanate compound in the toner is from 0.1% by weight to 10.0% by weight.

6. The toner of claim 1, wherein the toner has an acid value of from 5 KOH mg/g to 30 KOH mg/g.

7. The toner of claim 1, wherein the titanate compound contains iron in an amount of from 100 ppm to 500 ppm.

8. The toner of claim 1, wherein the titanate compound has a number average particle diameter of from 50 nm to 400 nm and a standard deviation of particle diameter of not more than 250 nm.

9. The toner of claim 1, wherein an amount of the titanate compound is form 0.3% by weight to 5.0% by weight.

10. The toner of claim 1, wherein an amount of the titanate compound is from 0.4% by weight to 2.0% by weight.

11. The toner of claim 1, wherein an acid value of the toner is from 7 KOH mg/g to 25 KOH mg/g.

* * * * *